US005682085A

United States Patent [19]

Suzuki et al.

[11] Patent Number: 5,682,085

[45] Date of Patent: Oct. 28, 1997

[54] MULTI-ELECTRON BEAM SOURCE AND IMAGE DISPLAY DEVICE USING THE SAME

[75] Inventors: Hidetoshi Suzuki; Ichiro Nomura, both of Atsugi; Tetsuya Kaneko, Yokohama; Haruhito Ono, Minami-ashigara, all of Japan

[73] Assignee: Canon Kabushiki Kaisha, Tokyo, Japan

[21] Appl. No.: 467,900

[22] Filed: Jun. 6, 1995

Related U.S. Application Data

[63] Continuation of Ser. No. 57,544, May 6, 1993, abandoned, which is a continuation-in-part of Ser. No. 10,436, Jan. 28, 1993, abandoned.

[30] Foreign Application Priority Data

May 23, 1990 [JP] Japan ..... 2-131347

[51] Int. Cl.[6] ..... G09G 3/10

[52] U.S. Cl. ..... 315/169.1; 315/334

[58] Field of Search ..... 315/169.1, 334, 315/337; 313/309, 336, 351, 409; 340/781

[56] References Cited

U.S. PATENT DOCUMENTS 4,626,899 12/1986 Tomii et al. ..... 358/65

4,754,203 6/1988 Murakami ..... 315/169.1

4,904,095 2/1990 Tsukamoto et al. ..... 313/336

4,954,752 9/1990 Young et al. ..... 315/169.1

5,272,419 12/1993 Dark ..... 315/169.1

*Primary Examiner*—Robert Pascal

*Assistant Examiner*—Darins Gambino

*Attorney, Agent, or Firm*—Fitzpatrick, Cella, Harper & Scinto

[57] ABSTRACT

A multi-electron beam source comprises an electron emitting element part including: a plurality of electron emitting elements provided two-dimensionally in a matrix-like arrangement on a substrate; opposing terminals of electron emitting elements arranged adjacently in the column direction thereof being electrically connected to each other; terminals on the same side of all the electron emitting elements in the same row being electrically connected; and the plurality of electron emitting elements being arranged in "m" rows, "m" representing a number of two or more, and a driving circuit part for driving said electron emitting element part. The multi-electron beam source has means for removing a spike noise superposed onto the driving pulse generated by said driving circuit part.

8 Claims, 17 Drawing Sheets

GRID ELECTRODE TERMINALS
X
Y
FP
Gh
GR
$G_N$
$G_{N-1}$
$G_3$
$G_2$
$G_1$
VC
$Ex_{l+1}$
$Ex_3$
$Ex_2$
$Ex_1$
S
$E_2$
$E_1$
108
109
107
104
106
106
106
106

MULTI-ELECTRON BEAM SOURCE AND IMAGE DISPLAY DEVICE USING THE SAME

This application is a continuation of application Ser. No. 08/057,544 filed May 6, 1993, now abandoned which is a CIP of application Ser. No. 08/010,436, filed Jan. 28, 1993, abandoned.

BACKGROUND OF THE INVENTION

1. Field of the Invention

The present invention relates to a multi-electron beam device and to an image display device using the same, having a large number of electron emitting elements arranged in a plurality of rows.

2. Related Background Art

A cold cathode element for example disclosed by M. I. Elinson (M. I. Elinson) and others has been known as the element by which electron emission may be achieved based on a simple structure. [Radio Engineering Electron Physics (Radio Eng. Electron Phys.) Vol.10, pp.1290–1296, 1965].

It uses the phenomenon that electron emission occurs when an electric current is caused to flow through a film having a small area formed on a substrate in parallel to the film surface thereof, which is generally called as a surface conduction type electron emitting element.

Among those made known to the public as such surface conduction type electron emitting elements are: one using $SnO_2$(Sb) thin film developed by Elinson and others as described above; one based on Au film [G. Dittmer "Thin Solid Films" (G. Dittmer: "Thin Solid Film), Vol.9, p.317, (1972)]; one based on an ITO film [M. Hartwell and C. G. Fonstad: "IEEE Trans" ED Conf. (M. Hartwell and C. G. Fonstad: "IEEE Trans. ED Conf.") p.519, (1975)]; one based on Carbon film [Araki Hisashi and Others: "Shinku", Vol.26, No.1, p.22, (1983)]. Also, there is known one using Pd, in place of an the above $SnO_2$, Au or ITO, as a material of electron emitting portion, which is described in Japanese Patent Application Laid-open No. 1-279542.

Further, in addition to the surface conduction type electron emitting elements, such cold cathode elements as an MIM type electron emitting element and a finely fabricated filed emission electron gun have been reported.

These cold cathode elements have such advantages as that:

1) a high electron emission efficiency may be achieved;
2) they are easily fabricated because of their simple structure; and
3) a large number of elements may be arranged into an array on a single substrate.

Thus the present inventors have already proposed a method as shown in FIG. 1 as the method in which a large number of such cold cathode elements are densely arranged into an array and at the same time resistance of the electric wiring thereof is reduced. In the figure, ES represents an electron emitting element and $E_1$–$E_{m+1}$ denote distributing electrodes, forming an array having "m" rows of electron emitting elements. This functional region is called an electron emitting element part.

In this device, any one of the rows may be selectively driven, i.e., by for example applying a driving voltage $V_E$[V] only to an electrode $E_1$ and 0 [V] to electrodes $E_2$–$E_{m+1}$, a driving voltage of $V_E$[V] is applied only to the elements in the first row where only the elements in that row are caused to emit electron beam. In general, it suffices to apply $V_E$[V] to electrodes $E_1$–$E_n$ and to apply 0 [V] to electrodes $E_{n+1}$–$E_{m+1}$ in order to drive the "n"th row, and, in the case where none of the columns is to be driven, it suffices to bring all of $E_1$–$E_{m+1}$ to the same potential (for example 0 [V]).

Such a multi-electron beam source capable of row-sequential drive is expected to be applicable for example to a flat panel CRT, since an electron beam source of XY-matrix type may be easily formed by providing grid electrodes perpendicularly to the rows of the elements.

In the case where the multi-electron beam source as shown in FIG. 1 is driven by an electric circuit, however, there has been a problem that a spike-like voltage is applied to those rows of elements which, in theory, are to halt. FIG. 2 and FIG. 3 are provided to explain such a problem.

First, FIG. 2 shows a typical example of the circuit for use in driving the multi-electron beam source of FIG. 1 as described above. In the figure, switching elements such as field-effect transistors (FET) are connected in the manner of a totem pole to the distributing electrodes represented by $E_1$–$E_{m+1}$, where, by suitably controlling gate signals $GP_1$–$GP_{m+1}$ and $GN_1$–$GN_{m+1}$ of the respective FET, 0 [V] (ground level) or VE[V] may be selectively applied to each distributing electrode. This functional region is called a driving circuit part.

FIG. 3 is a graph exemplifying the voltage to be applied to each section when driving the multi-electron beam source of FIG. 2 as described. As shown in (1) of the figure, the case is assumed where the rows of the elements are sequentially driven with in-between halt periods, starting from the first row. (Such driver means is practiced when a multi-electron beam source is utilized for a flat panel CRT.)

In performing such drive, rectangular voltage pulses of $V_E$[V] are applied to the distributing electrodes $E_1$–$E_4$ at timings as indicated by (2)–(5) of the same figure. For example, since the difference in voltage between (2) and (3) is applied to the first row, $V_E$[V] is applied thereto at the first row's driving timing as indicated in (1). Thereafter, the difference voltage between (3) and (4) to the second row and the difference voltage between (4) and (5) to the third row are respectively applied in a similar manner.

However, when the voltage applied to each row of the elements is actually observed for example using an oscilloscope, it is seen that, as indicated in (6)–(8) of the same figure, a spike-like voltage SP(+) (indicated by dotted line in the figure) or SP(−) (indicated by solid line in the figure) is applied at timings at which another row of the elements is to be turned on or to be turned off.

Since such spike-like voltage is applied to the electron emitting elements, there has been a problem as follows. That is, since the electron beam is inevitably emitted due to the spike-like voltage at timings where it should be halted, an emission of light occurs at such timings where no light is to be emitted for example when they are adapted to the electron beam source of a flat panel CRT. The problem thus occurs that the contrast in an image is reduced.

In particular, when the negative voltage SP(−) of these spike-like voltages is applied to the electron emitting element, the electron emitting characteristics of each element may deteriorate at a considerably faster rate or be instantaneously destroyed, causing a large problem in applying the multi-electron beam source to such as a display device.

Such spike-like voltage occurs presumably because a shift in timing results in the waveform of the voltage applied to each electrode as indicated by the above described (2)–(5). For example, in the case of the first row, the electrode E1 and the electrode E2 should be simultaneously switched as 0

[V]→$V_E$[V] (or $V_E$[V]→0 [V]) at the timing where a row of the second or after is to be turned on (or off). If a shift occurs in such timing, application of spike-like voltages as indicated in (6) results.

At this time, whether spike SP(+) of a positive voltage results or spike SP(−) of a negative voltage results depends on which one of the applied voltage for $E_1$ and the applied voltage for $E_2$ is switched in advance.

The reason for the occurrence of a shift in timing of voltage waveform to be applied to each electrode includes: shift in gate signals $GP_1$–$GP_{m+1}$ and $GN_1$–$GN_{m+1}$ of FET's of the driver circuit as shown in FIG. 7 described above; and the fact that switching time varies according to the variance in characteristic of each FET.

Complete elimination, in terms of the electric circuitry, of the spike-like applied voltage SP(−) by adjusting the shift in the gate signals and/or the variance in FET characteristics is technologically very difficult and, from the viewpoint of costs, cannot be regarded as a practical solution.

SUMMARY OF THE INVENTION

Accordingly, it is an object of the present invention to provide a multi-electron beam source and an image display device using the same in which the problems as described above are subjugated.

In accordance with the present invention, there is provided a multi-electron beam source comprising an electron emitting element part including: a plurality of electron emitting elements provided two-dimensionally in a matrix-like arrangement on a substrate; opposing terminals of the electron emitting elements arranged adjacently in the column direction thereof being electrically connected to each other; terminals on the same side of all the electron emitting elements in the same row being electrically connected; and the plurality of electron emitting elements being arranged in "m" rows, "m" representing a number of two or more, and a driving circuit part for driving said electron emitting element part, wherein said multi-electron beam source has means for preventing a spike-like voltage from being applied to said electron emitting elements.

In accordance with the present invention, there is provided an image display device comprising the multi-electron beam source as described above; grid electrodes having a stripe shape in the column direction and arranged thereabove in the row direction of the two-dimensionally arranged electron emitting elements forming the multi-electron beam source; and a fluorescent material target for making an image visible by irradiation of electron beam provided further thereabove.

According to the present invention, said means for removing a spike noise include a rectifying element connected in parallel to the electron emitting elements of a row of electron emitting elements.

Further, according to the present invention, said means for removing a spike noise include a rectifying element connected in parallel to the electron emitting elements of a row of electron emitting elements, and a resistor connected in series to the rectifying element.

Further, according to the present invention, said driving circuit part has a driving pulse generating means and a switching means and said means for preventing a spike-like voltage is means for controlling the ON/OFF operation of said switching means during the period when the output voltage of said driving pulse generating means is lower than the electron emission threshold voltage of said electron emitting elements.

It is possible by the above described means to solve the problem of destruction of the electron emitting element or deterioration in the characteristic thereof which occurs due to application of the above described spike-like negative voltage SP(−).

Further, accidental application of a positive, abnormal (instantaneous high) voltage can be prevented. Additionally, in case of adding a resistor in series to each rectifying element, switching elements are also protected.

DESCRIPTION OF THE PREFERRED EMBODIMENTS

The present invention will now be described in detail by way of some specific embodiments.

EMBODIMENT 1

Figure 4:
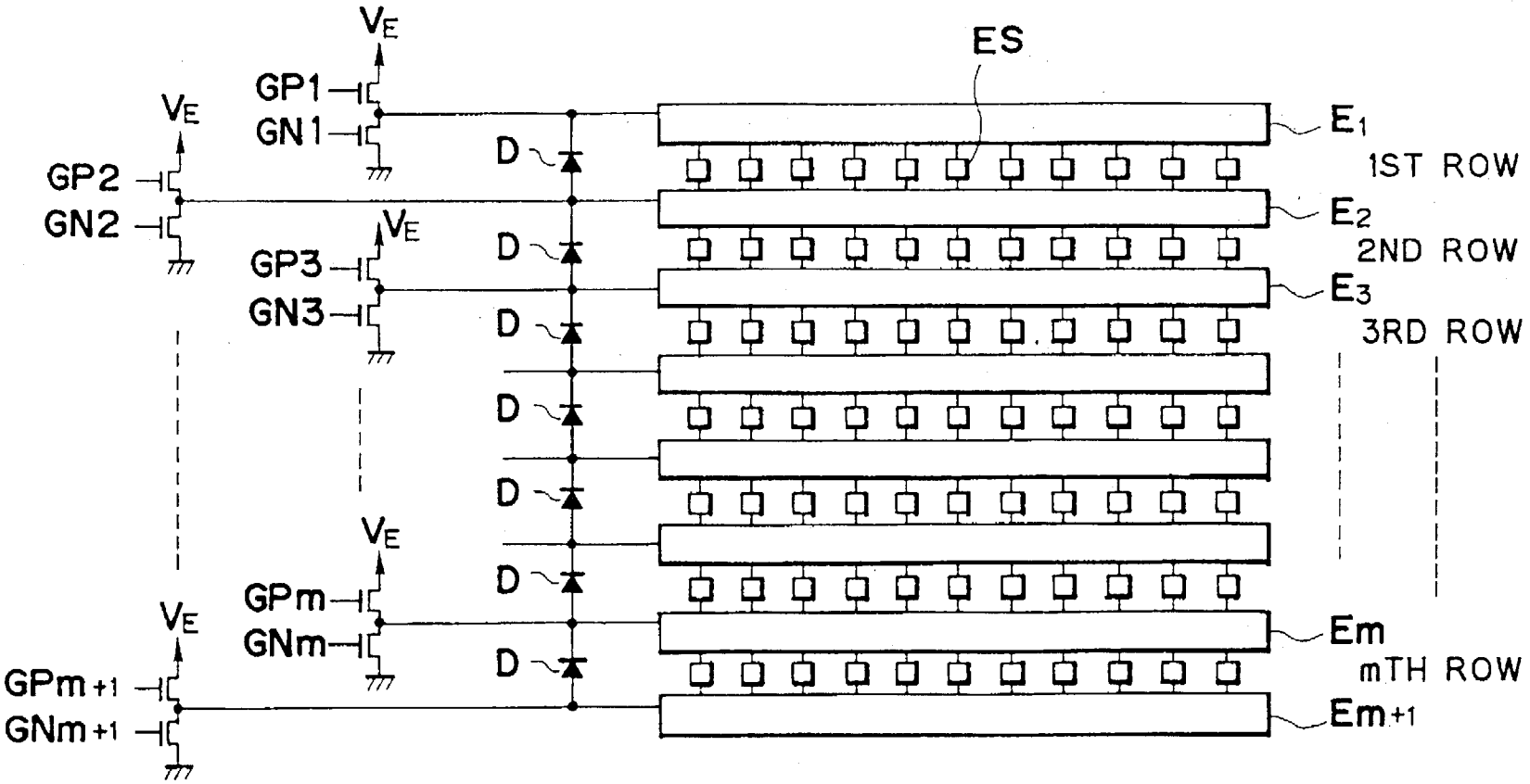
FIG. 4 is a simplified circuit diagram showing a multi-electron beam source according to the present invention.

FIG. 4 shows a first embodiment of the present invention, in which electron emitting elements ES, distributing electrodes $E_1$–$E_m$ and switching elements (FET) for applying drive voltage are similar to those described in the above section of Prior Art. In this figure, what is denoted by each D is a rectifying diode which is provided for each column of the electron emitting elements in parallel with the electron emitting elements thereof. Such a diode D is oriented so that, at "n"th-column, its anode is connected to distributing electrode $E_{m+1}$ while its cathode is connected to distributing electrode $E_m$.

According to such construction, when a column of the electron emitting element is driven in accordance with the procedure described with reference to FIG. 3, the drive voltage $V_E$ of the electron emitting element acts as a reverse direction voltage while spike-like reverse voltage SP(–) acts as a forward direction voltage with respect to the diode D.

Figure 5:
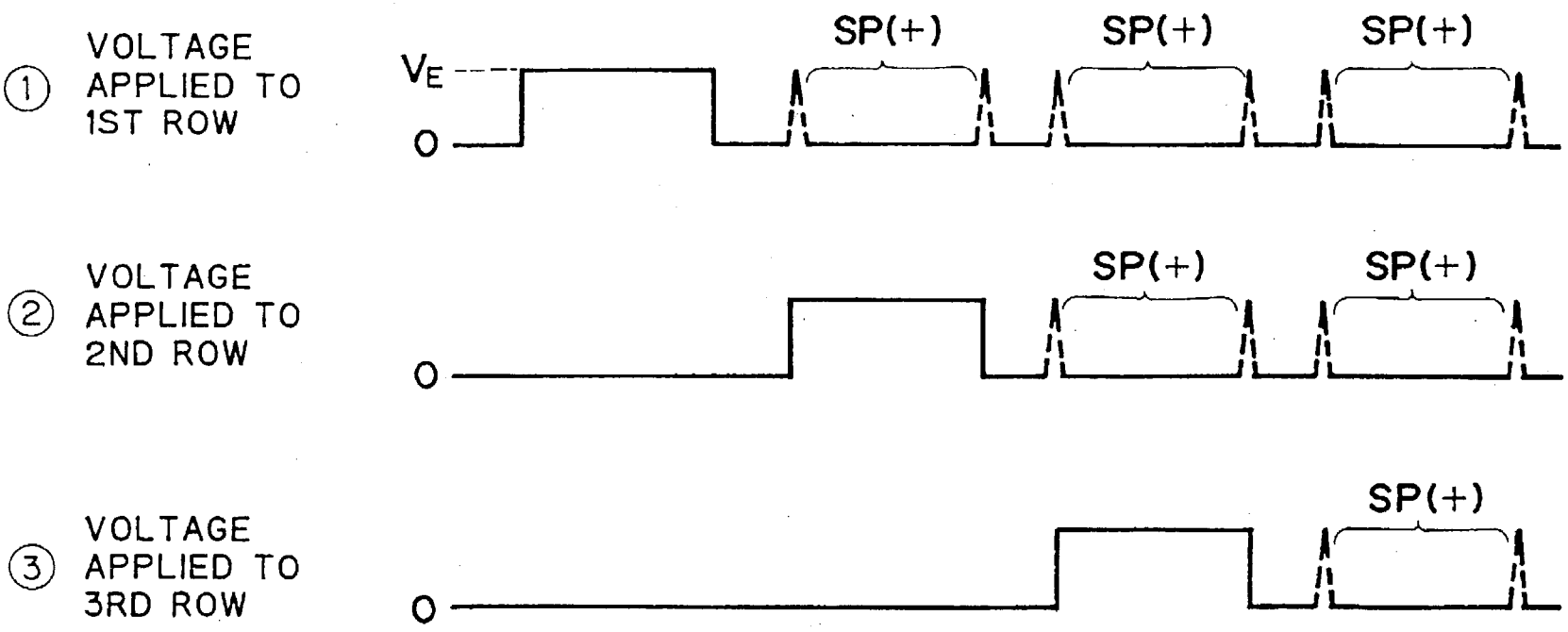
FIG. 5 is a graph of applied voltages for showing the effect of the present invention.

Thus, due to the action of such a diode D, voltage waveform to be applied to each electron emitting element column becomes as indicated by FIGS. (1), (2), (3) in FIG. 5. (Note that the graphs correspond respectively to the voltage waveforms of FIGS. (6), (7), (8) in FIG. 3 as described.)

In other words, since spike-like negative voltage SP(–) is not applied to each electron emitting element column, such phenomenon as deterioration in characteristic or destruction of electron emitting element which has been a problem becomes difficult to occur, succeeding in making longer the life of a multi-electron beam source to the level of practical use.

Figure 6:
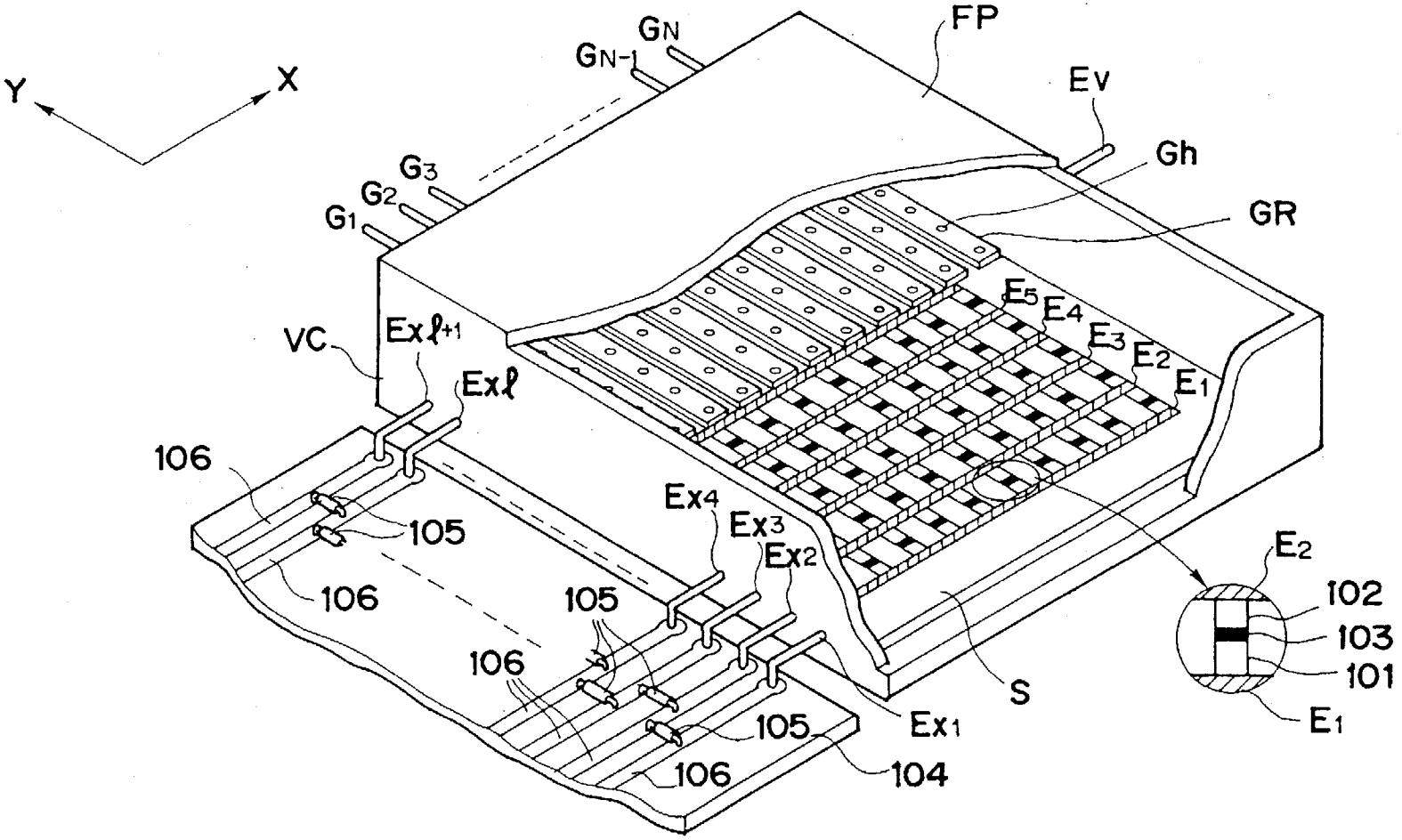
FIG. 6 is a perspective view of a flat panel display device using the multi-electron beam source according to the present invention.

An example will now be described by way of FIG. 6, where a multi-electron beam source suitably using the present invention is applied to a flat panel image display device.

In this figure, what is denoted by VC is a vacuum vessel made of glass and FP, a part thereof, denotes a faceplate on the display surface side. Transparent electrode using such materials as ITO is formed on the internal surface of the faceplate FP and, at further inner side thereof, fluorescent materials of red, green and blue are painted separately in the manner of a mosaic so as to apply metal-backed processing which is known in the field of CRT. (Transparent electrode, fluorescent material and metal-back are not shown). Further, the above described transparent electrode is electrically connected to the outside of the vacuum vessel through terminal EV so as to apply acceleration voltage.

In addition, what is denoted by S is a glass base plate fixed to the bottom surface of the above vacuum vessel VC and, upon the upper surface thereof, electron emitting elements are formed in the arrangement of N×1 columns. The electron emitting element groups are connected electrically parallel by each column by means of wiring $E_1$, $E_2$, $E_3$, . . . , the wirings $E_1$, $E_2$, $E_3$, . . . being electrically connected to the outside of the vacuum vessel by means of the respective terminals $E_{x1}$, $E_{x2}$, $E_{x3}$, . . . $E_{x1+1}$. Such terminals $E_{x1}$–$E_{x1+1}$ are electrically connected to a driver circuit (not shown) through wiring patterns 106 provided on a substrate 104 which is made of an insulating material. Further, diodes 105 are respectively connected to the wiring patterns 106, these corresponding to diode D described with reference to FIG. 4.

It should be noted that what is shown in a circle in the figure in an enlarged manner is an example of electron emitting element, shown is a surface conduction type emitting element which consists of a positive electrode 101, a negative electrode 102 and an electron emitting section 103.

Further, a stripe like grid electrode is provided at some point between the base plate S and the faceplate FP. The grid electrodes are provided in N pieces perpendicular to the above described columns of the elements, each electrode being provided with an empty hole Gh for transmitting electron beam. The empty holes may be provided in one-to-one correspondence to each electron emitting element as shown in the example of FIG. 6 or a large number of fine holes may be provided in a mesh-like manner. Each grid electrode is electrically connected to the outside of the vacuum vessel by means of terminals $G_1$–$G_n$.

In this device, an XY matrix is formed by "1" electron emitting element columns and "N" grid electrode rows. Thus, by simultaneously applying modulation signal corresponding to a line of image to the grid electrode column in synchronization with the sequential drive (scanning) of the electron emitting columns by a column at a time, irradiation of each electron beam onto the fluorescent material is controlled to display an image line by line.

Here, in a conventional display device having a similar construction but without diode 105, deterioration in image quality such as irregularity of luminance and defect in pixel which are the problem in practical use have been caused relatively more frequently after several tens to several hundreds of hours. In the display device of the present invention, however, deterioration in image quality due to deterioration of characteristic of the electron emitting element did not occur for at least one thousand hours.

EMBODIMENT 2

Figure 7:
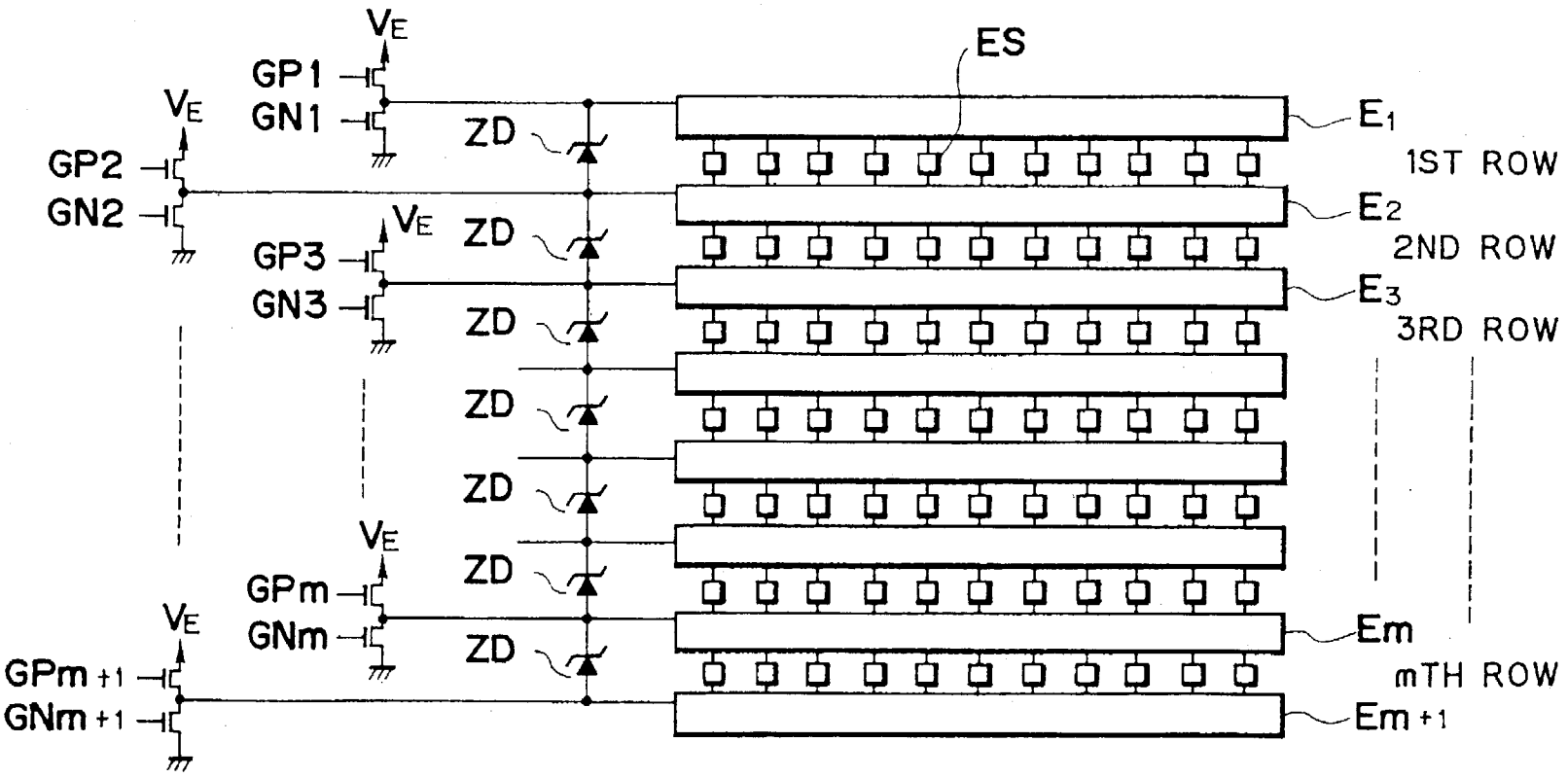
FIG. 7 shows a multi-electron beam source using Zener diode as the rectifying device according to the present invention.

FIG. 7 shows the case where Zener diode ZD is connected instead of the diode D in the above described first embodiment. In this case, in addition to the effect similar to that of the first embodiment for preventing the application of spike-like reverse voltage SP(–) to the electron emitting element, another effect may also be achieved, where a suitable Zener voltage (for example $1.3\times V_E$[V]) is selected to prevent application of abnormal voltage of positive polarity (a voltage exceeding $1.3\times V_E$[V]) to the electron emitting element.

This multi-electron beam source was used for a flat plate-like image display device having a similar structure to one in Embodiment 1 and a similar result was obtained.

EMBODIMENT 3

Figure 8:
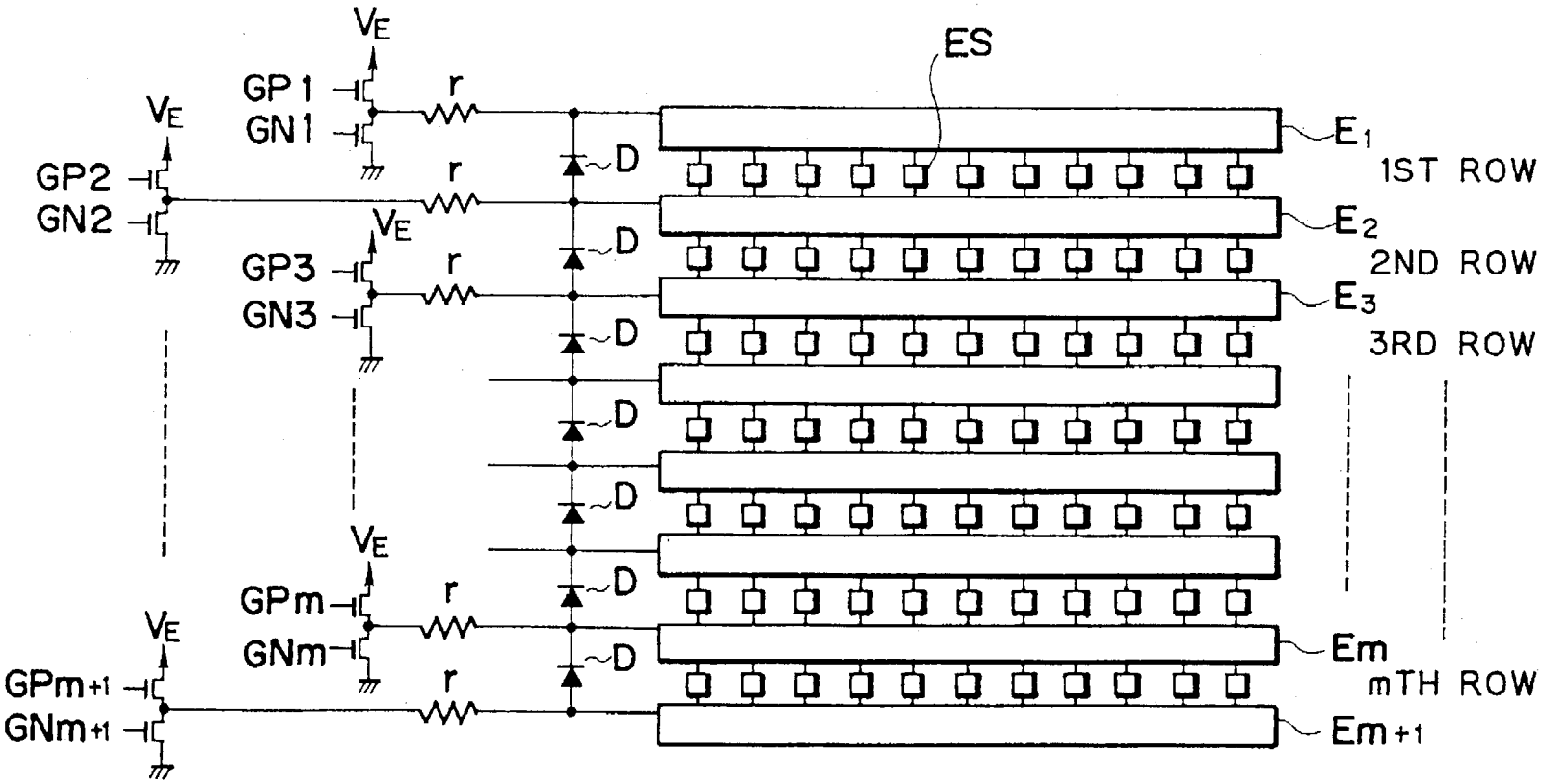
FIG. 8 shows an electron source obtained by connecting current-limiting resistance to the multi-electron beam source as shown in FIG. 1.

FIG. 8 shows an example where current limiting resistances r are connected serially to diodes D of the above described first embodiment, provided to limit a spike-like current flowing through switching elements accompanying the spike-like reverse voltage SP(–). It is, however, desirable that the value of the current limiting resistance r is sufficiently smaller than the parallel resistance of a column of electron emitting elements so as to control unnecessary power consumption. For example, if 100 electron emitting elements are connected in parallel where a single element has a resistance value of 10KΩ, the parallel resistance for one column is 100Ω. In such a case, 1Ω, for example, may be used as "r" so that it is caused to function as the protecting resistance of the switching element without substantially increasing the power consumption.

This multi-electron beam source was used for a flat plate-like image display device having a similar structure to one in Embodiment 1 and a similar result was obtained.

Incidentally, a Zener diode may be used as a rectifying element as in Embodiment 2.

As has been described, by providing a rectifying device in parallel to each column of the columns of the electron emitting elements which are electrically connected in parallel to each other, an advantage is achieved that application of spike-like reverse voltage to the electron emitting element may be prevented. As a result, it is possible to prevent deterioration of electron emitting characteristic of the electron emitting element or destruction thereof so that the life of practical use of the multi-electron beam source may be greatly extended. Also, accidental application of a positive, abnormal voltage can be prevented. Additionally, in case of adding a resistor in series to each rectifying element, switching elements are protected.

Further, by applying the multi-electron beam source of the present invention to a flat panel display device, it is possible to maintain the initial image quality for at least one thousand hours while, conventionally, irregularity of luminance or image defect has occurred after several tens to several hundreds of hours, thereby it is possible to greatly improve the practicality thereof.

EMBODIMENT 4

Figure 1:
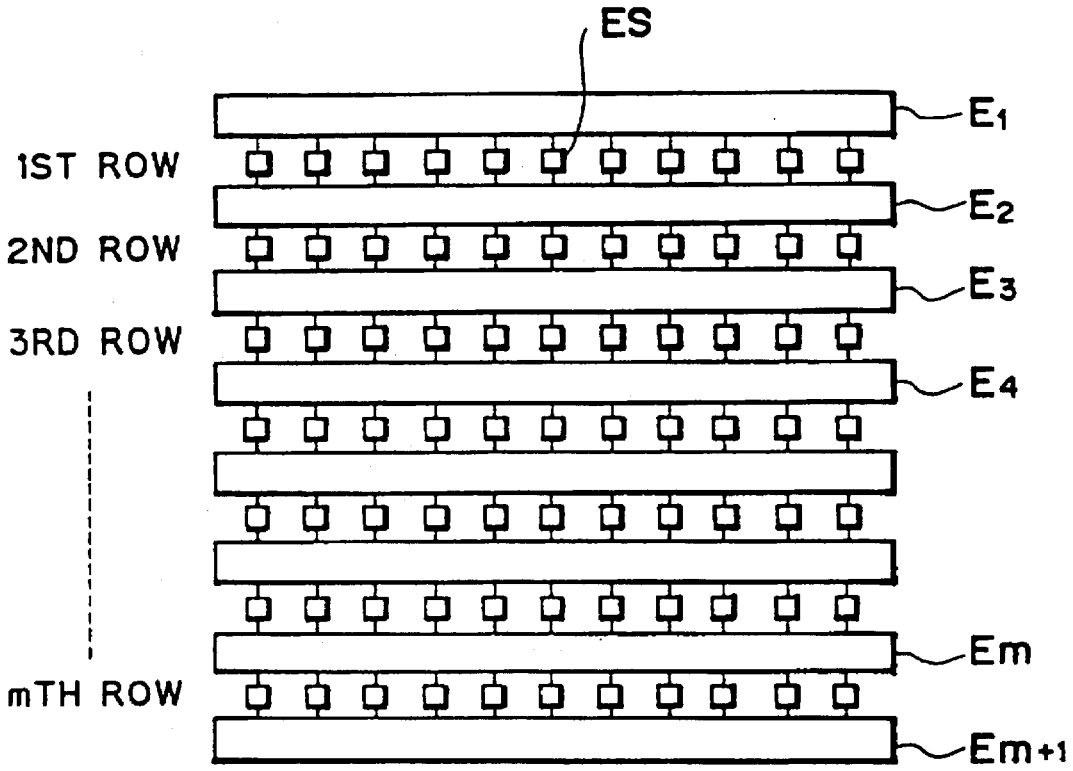
FIG. 1 PRIOR ART
FIG. 1 shows the arrangement of electron emitting elements of the multi-electron beam source to which the present invention is applied.
Figure 9:
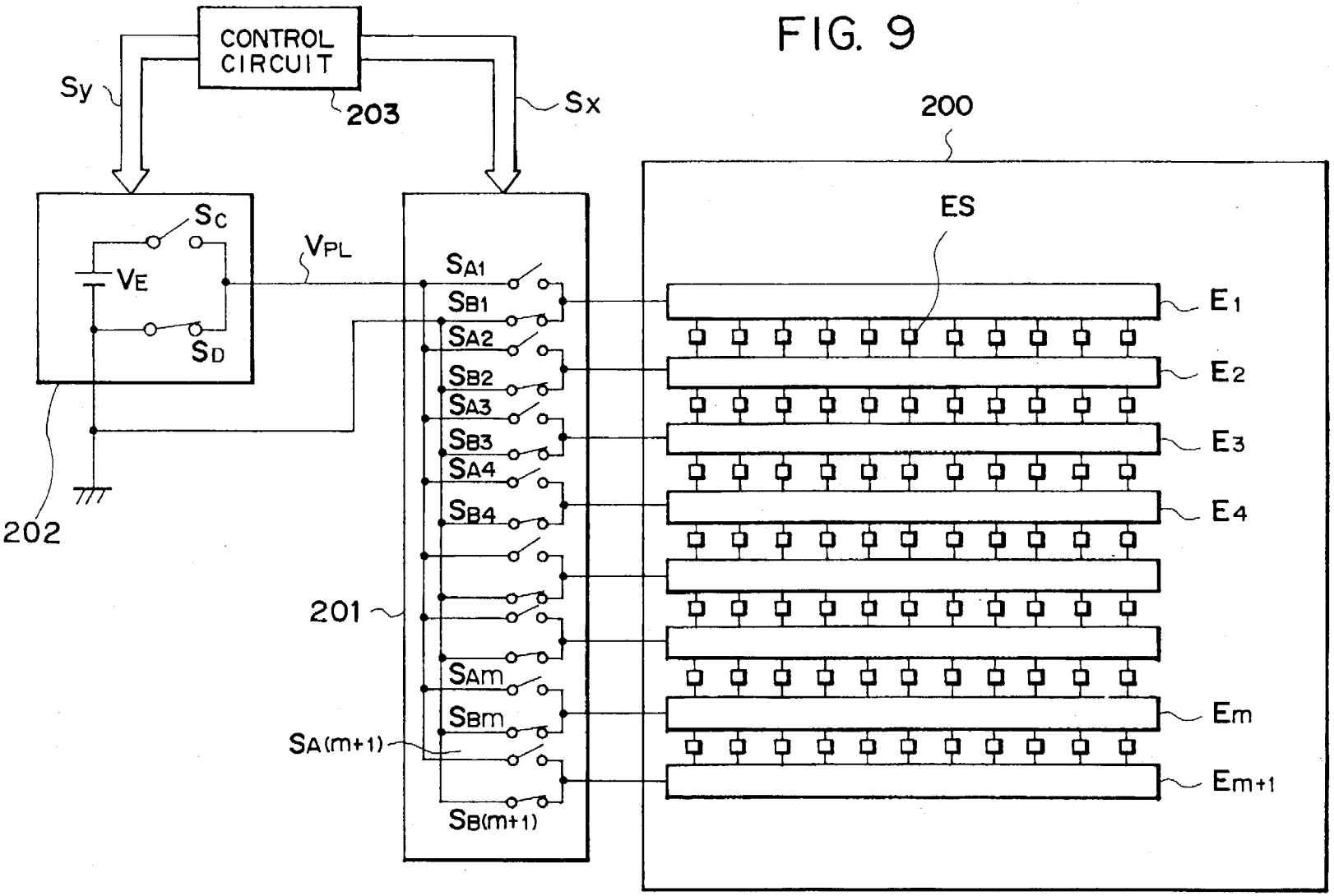
FIG. 9 is a circuit diagram showing the fundamental construction of embodiment 4.

FIG. 9 shows the fundamental construction of an embodiment of the multi-electron beam source of the present invention. In the figure, what is denoted by numeral 200 is an electron emitting element array similar to one described with reference to FIG. 1, numeral 201 denotes a switching element array, numeral 202 denotes a pulse generator for generating rectangular pulses, and numeral 203 denotes a control circuit.

Here, the electron emitting element array 200 has "m" columns of electron emitting element groups wired in the manner of a ladder by means of distributing electrodes $E_1$–$E_{m+1}$, each distributing electrode being electrically connected to the switching element array 201. In the switching element array 201, two switching elements are provided for each distributing electrode, for example, $S_{A1}$ and $S_{B1}$ for the distributing electrode $E_1$. The switching elements $S_{AN}$ and $S_{BN}$ (N representing 1–m+1) operate exclusively of each other so that, for example, $S_{BN}$ is turned OFF when $S_{AN}$ is ON and $S_{BN}$ is ON when $S_{AN}$ is OFF. The switching element $S_{AN}$ is provided to apply the output voltage $V_{PL}$ of the rectangular pulse generator 202 to the distributing electrode $E_N$, while the switching element $S_{BN}$ is provided to connect the distributing electrode $E_N$ to the negative electrode (ground level) of the rectangular pulse generator 202. All the switching elements $S_{A1}$–$S_{A(m+1)}$ and $S_{B1}$–$S_{B(m+1)}$ within the array 201 are to be controlled in their operation by control signal $S_X$ generated by the control circuit 203.

Further, the rectangular pulse generator 202 generates a rectangular voltage pulse with a peak value of $V_E$[V] on the basis of a signal $S_Y$ generated by the control circuit 203. In this figure, an example is shown where it is constituted by mutually exclusively operated switching elements $S_C$ and $S_D$ and a constant voltage source $V_E$.

Further, the control circuit 203 as described is the circuit for controlling the voltage pulse generation timing of the rectangular pulse generator 202 and operation of the respective switching elements in the switching element array 201. It is constituted by a microprocessor or known logic circuits.

The operation timing of the respective sections of the circuits as shown in FIG. 9 will now be described with reference to FIG. 10. Indicated by (1) of this figure is the output waveform generated by the rectangular pulse generator 201, rectangular voltage pulses with peak value $V_E$[V] and pulse length $T_p$[S] being output as shown in the figure with spacing of $T_B$[S]. At this time, it is desirable that quiescent period $T_B$[S] of the pulse voltage is set to have a width that is at least four times the variance in switching speed of the switches $S_{A1}$–$S_{B(m+1)}$ which constitute the switching element array 201. For example, if, of $S_{A1}$–$S_{B(m+1)}$, the difference in switching speed between one with the fastest switching speed and another with the slowest switching speed is about 1.0 [μs], it is desirable that $T_B$[S] has a width of at least 4 [μs].

While the rectangular pulse generator 202 generates the rectangular voltage pulse as the above described (1), the switching elements within the switching element array 201 are respectively operated on the basis of the control signal $S_X$, (2)–(7) of FIG. 7 indicating the operation state of switching elements $S_{A1}$, $S_{B1}$, $S_{A2}$, $S_{B2}$, $S_{A3}$, $S_{B3}$. As shown in the figure, operation of $S_{A1}$ and $S_{B1}$, $S_{A2}$ and $S_{B2}$ or $S_{A3}$ and $S_{B3}$ are operated mutually exclusively. Each of these switching elements is controlled so that its transition of ON→OFF or OFF→ON (shown by dotted arrows in the figure) is performed only when the output voltage $V_{PL}$ of the triangular pulse generator 201 is 0 [V]. As a result that the switching elements are operated as shown in the above described (2)–(7), voltage waveform as indicated by (8), (9), (10) of FIG. 10 are applied to the distributing electrodes $E_1$, $E_2$, $E_3$ of the electron emitting elements. Comparing to the applied voltage waveform in the above described conventional example ((2), (3), (4) of FIG. 3), such applied voltage waveform is with a substantially smaller shift in timing of ascending or descending of voltage, and thus spike-like voltages SP(+), SP(−) such as indicated by (6), (7), (8) of FIG. 3 as described do not occur in the drive voltage to be applied to the electron emitting element array.

Figure 10:
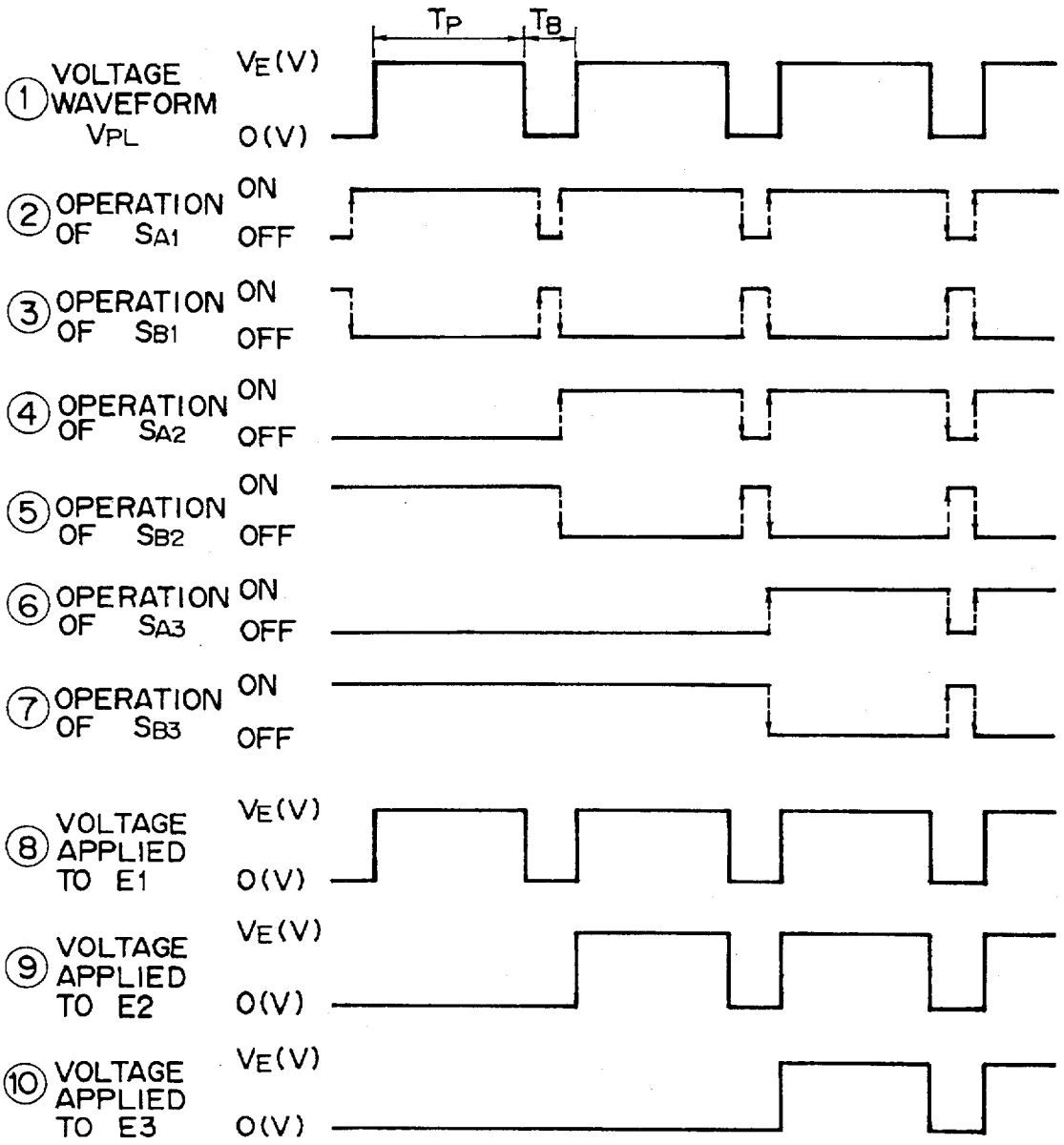
FIG. 10 is a timing chart showing an example of operation of the respective sections of the circuit shown in FIG. 9.

Shift in timing of ascending and descending of the voltage waveform of (8), (9), (10) of FIG. 10 may be made smaller in the present invention to such extent as ignorable comparing to the conventional example due to the following reasons.

That is, in general, an electrical signal to be transmitted by a switching element is delayed in time from the input signal by the amount corresponding to switching time required in switching of the element and time of transmission delay required for transmitting the signal. When, of these, variance in characteristic of each switching element is noticed, the variance in the transmitting delay time according to each element is very small, while the switching time generally varies largely according to each element. Since, in the conventional system of FIG. 2 as described, timing of ascending or descending of the voltage to be applied to each distributing electrode corresponds to ON/OFF transition of the switching element, the variance in switching time of each element as it is results in shift in timing of the voltage to be applied to the distributing electrode. Further, if there is some shift in timing of the gate signals $GP_1$–$GP_{m+1}$, $GN_1$–$GN_{m+1}$ which control the operation of the switching elements of FIG. 2, this also results in shift in timing of the voltage to be applied to the distributing electrodes.

On the other hand, in the embodiment of the present invention of FIG. 9, ON/OFF transition of the switching elements is controlled to be performed only in the time periods during which the output voltage of the rectangular pulse generator 202 is 0 [V] as described with reference to the timing chart of (1)–(7) of FIG. 10. In addition, $T_B$ is set to a sufficiently large value comparing to the variance in switching time. Thus, even if some variance occurs in switching time, it does not affect shift in timing of the voltage waveform of (8), (9), (10) of FIG. 10.

The voltage waveform of the above described (8), (9), (10) is of course delayed in its ascending and descending corresponding to transmission delay time of the switching elements with respect to the output voltage $V_{PL}$ of the rectangular pulse generator. Since, however, variance in transmission delay time according to each switching element is very small as described, the shift in timing becomes ignorably small comparing to the conventional example.

Figure 2:
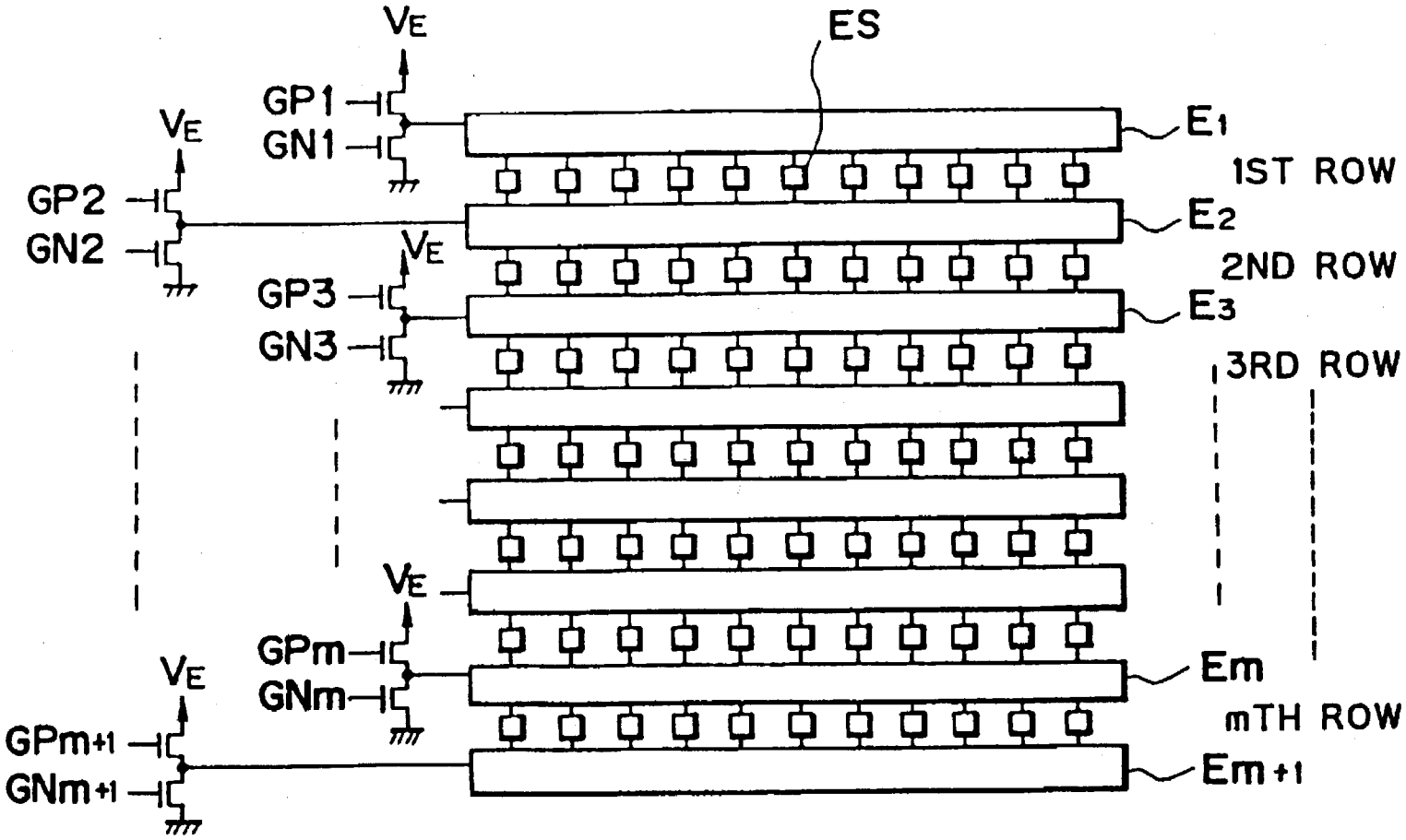
FIG. 2 PRIOR ART
FIG. 2 shows an example of switching elements for drive to be used in the electron source of FIG. 1.

While construction and operation of the present invention have been described, the electron emitting element rows thereof were consecutively driven by the method as shown in FIG. 2. It was confirmed to be effective in preventing emission of electron occurring at unnecessary timings and in making longer the life of the electron emitting element ten times or more comparing to the driving method which accompanies spike-like voltages as shown in FIG. 3.

In the fundamental construction of FIG. 9 as described, driving method capable of preventing occurrence of the spike-like voltage is not limited to the above example as described with reference to FIG. 10. For example, it is also possible to control the rectangular pulse generator 202 and the switch array 201 in the manner as shown in FIG. 11.

Figure 11:
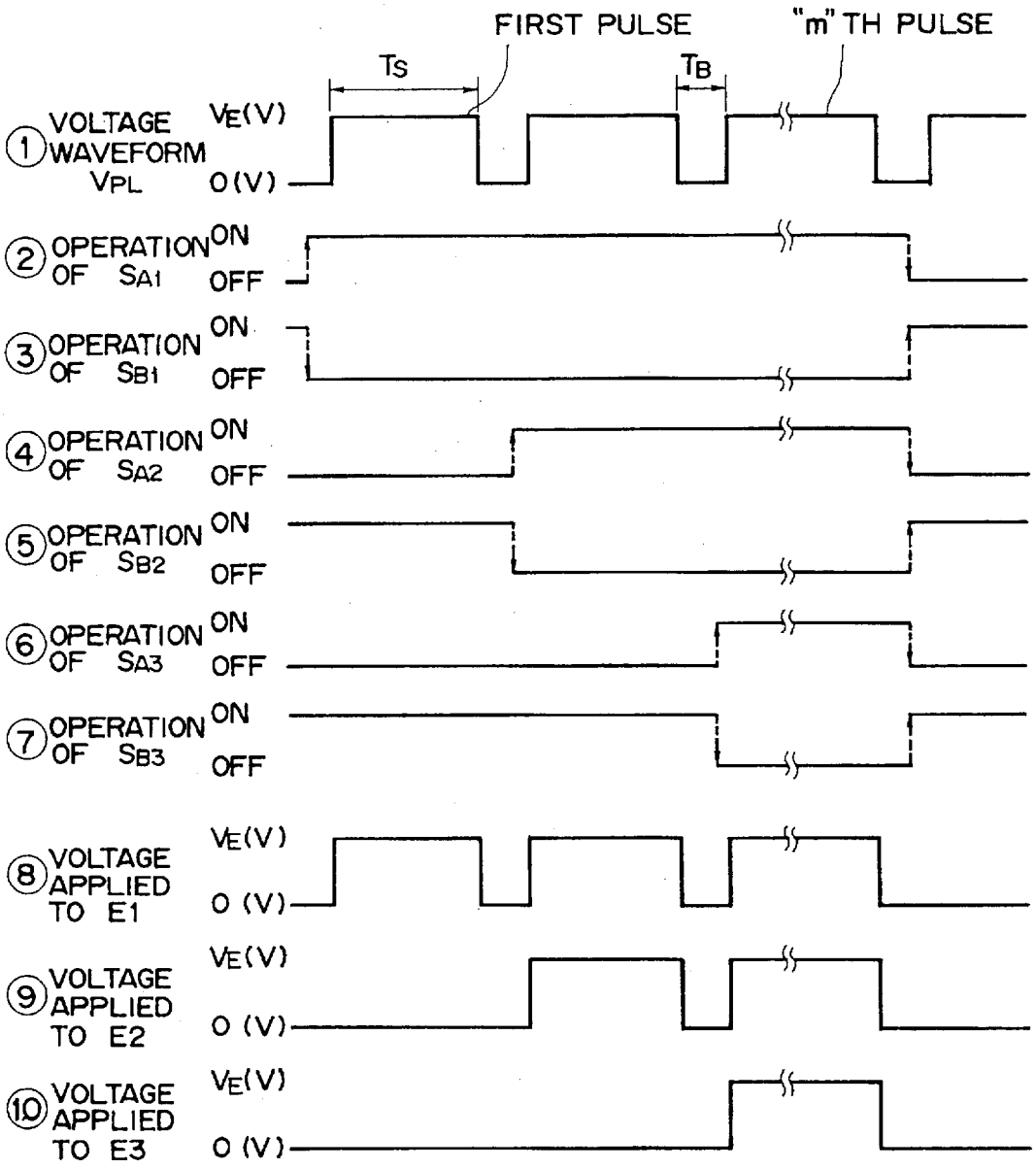
FIG. 11 is a timing chart showing a second example of operation of the respective sections of the circuit shown in FIG. 9.

Referring to FIG. 11, what is indicated by (1) is the output voltage of the rectangular pulse generator 202, the rectangular pulse having a peak value of $V_E$[V]. Indicated by (1)–(7) of the same figure are the state of operation respectively of the switching elements $S_{A1}$, $S_{B1}$, $S_{A2}$, $S_{B2}$, $S_{A3}$, $S_{B3}$, within the switching element array 201. In the present embodiment, when noticing $S_{A1}$ and $S_{A2}$ for example, after making transition to ON or OFF before the rectangular pulse generator 202 generates the first pulse, they are maintained in that state until the rectangular pulse generator 202 completes pulse generation of "m" times. Further, when $S_{A2}$ and $S_{B2}$ are noticed, while they transit to ON or OFF after the generation of the first pulse by the rectangular pulse generator, they are maintained in that state thereafter until completion of (m–1) times of pulse generation. After the generation of the second pulse, $S_{A3}$ and $S_{B3}$ are caused to transit and maintain their respective state until the completion of (m–2) times of pulse generation. By sequentially controlling $S_{A3}$–$S_{Am}$, $S_{B3}$–$S_{Bm}$, in this manner, the pulse voltage is applied successively to the distributing electrodes E1–Em, thereby it is possible to perform electron emission in succession starting from the first row of the electron emitting elements. It should be noted that, in such a case, since it suffices to leave the distributing electrode $E_{m+1}$ to the ground level, $S_{A(m+1)}$ and $S_{B(m+1)}$ may be kept at all times to ON and OFF, respectively.

In the mode of the present embodiment, too, since an influence due to the variance in switching time of the switching elements is avoided similarly to the case of FIG. 10, it is possible to effectively prevent application of spike-like voltage on the electron emitting element array. It should be noted that, while in the embodiment of FIG. 10 as described it is desirable to set the interval $T_B$ of the rectangular voltage pulse to four times or more with respect to the variance in switching time of the switching elements, it suffices to set $T_B$ in the present embodiment to two times or more with respect to the variance in switching time.

While the embodiment based on the fundamental construction of FIG. 9 has been described, the drive voltage waveform for the electron emitting element is not necessarily limited to the rectangular waveform. For example, triangular wave and trapezoidal wave or sinusoidal wave may also be used as the drive waveform, as far as the waveform causes no harm to the electron emitting characteristic of the electron emitting elements. In such a case, a pulse generator for generating voltage pulses of a desired waveform on the basis of the control signal Sy may be used instead of the rectangular pulse generator 202.

Figure 12:
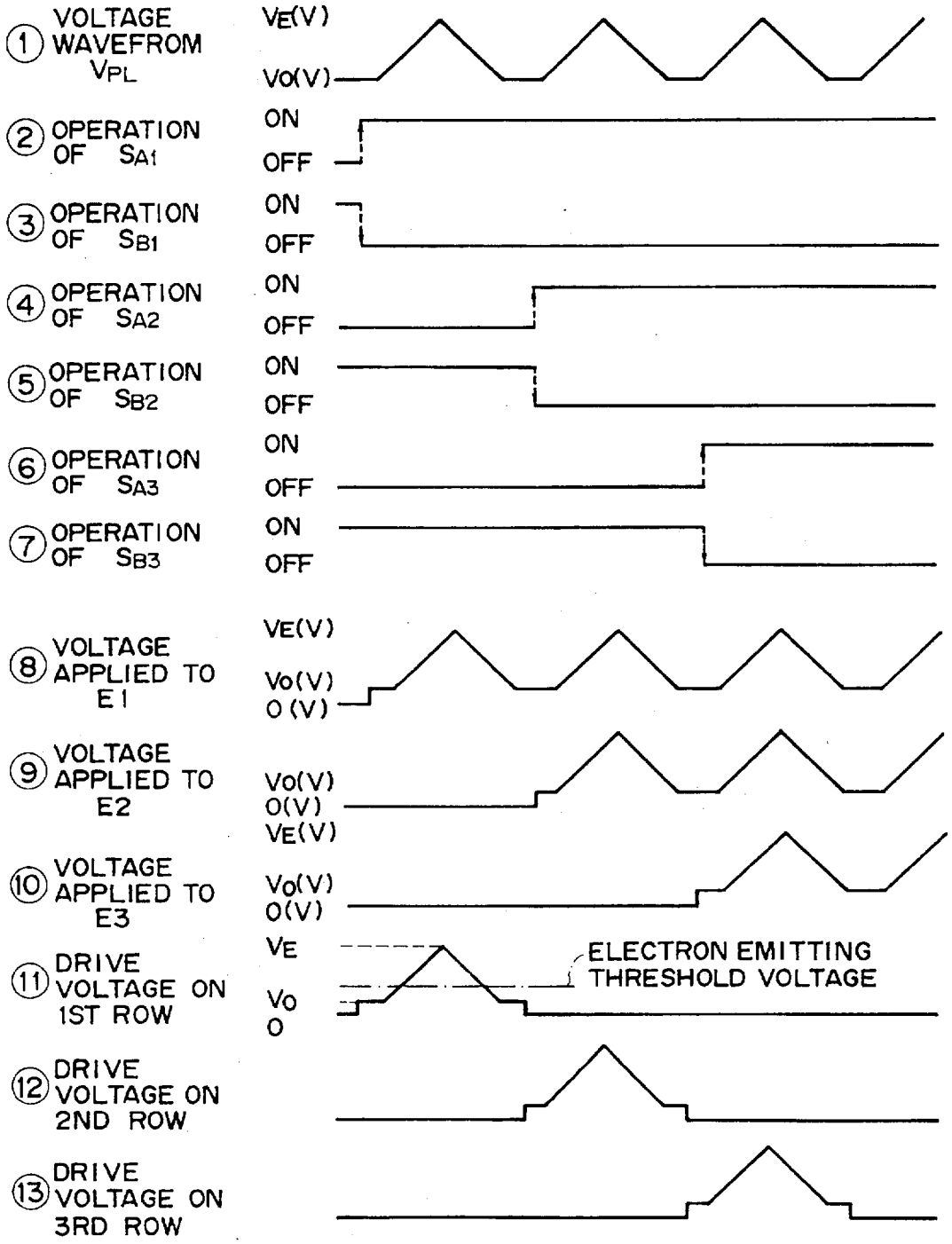
FIG. 12 is a timing chart showing an example in which the pulse waveform comprises a triangular waveform.

Shown in FIG. 12 is an example of the case where triangular pulse is used as the drive voltage waveform, (1) thereof showing the voltage waveform generated by the pulse generator, (2)–(7) showing operation state of switching elements, (8)–(10) showing voltage to be applied to the distributing electrodes E1–E3, respectively. It is assumed that the triangular pulse, as shown in (1), has a peak voltage of $V_E$[V] and a bias voltage of $V_0$[V] is applied at the interval between a pulse and another pulse. While $V_0$=0 [V] is usually set, the value of 0 [V] is not necessarily required to prevent unnecessary electron emission as far as the condition of $V_0$<(electron emission threshold voltage of the electron emitting element) is satisfied. Indicated by (11)–(13) of FIG. 12 are drive voltages to be applied to the first row–the third row of the electron emitting element array. According to the present invention, since ON/OFF transition of the switching elements is limited within the periods in which the drive voltage is $V_0$[V], voltage of triangular wave exceeding the electron emission threshold value is not applied to the electron emitting element array at unnecessary timings.

EMBODIMENT 5

Figure 13:
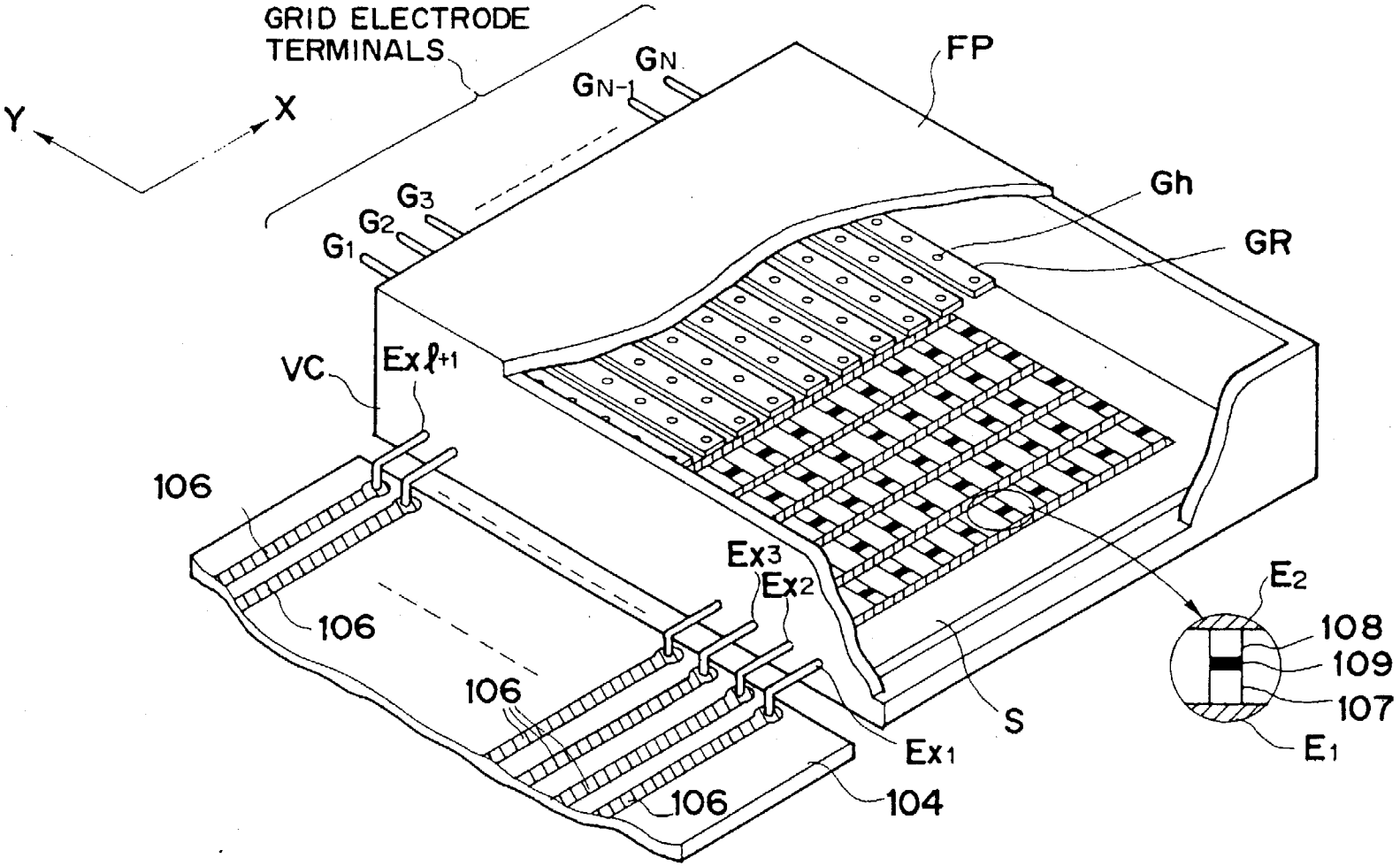
FIG. 13 is a perspective view of an image display device of Embodiment 5, with a portion thereof being removed.

FIG. 13 shows the construction of an example where the above described multi-electron beam source is applied to an image display device.

In this figure, what is denoted by VC is a vacuum vessel made of glass and FP, a part thereof, denotes a faceplate on the display surface side. Transparent electrode using such materials as ITO is formed on the internal surface of the faceplate FP and, at further inner side thereof, fluorescent materials of red, green and blue are painted separately in the manner of a mosaic so as to apply metal-backed processing which is known in the field of CRT. (Transparent electrode, fluorescent material and metal-back are not shown). Further, the above described transparent electrode is electrically connected to the outside of the vacuum vessel through terminal EV (not shown) so as to apply acceleration voltage.

In addition, what is denoted by S is a glass base plate fixed to the bottom surface of the above vacuum vessel VC and, upon the upper surface thereof, electron emitting elements are formed in the arrangement of 1 rows×N columns. The electron emitting element group is connected electrically parallel by each row by means of wiring $E_1$, $E_2$, $E_3$, . . . , the wirings $E_1$, $E_2$, $E_3$, . . . being electrically connected to the outside of the vacuum vessel by means of the respective terminals $E_{x1}$, $E_{x2}$, $E_{x3}$, . . . $E_{x1+1}$. The terminals $E_{x1}$–$E_{x1+1}$ are electrically connected to a switching element array (not shown) through wiring patterns 106 provided on a substrate 104 which is made of an insulating material. It should be noted that what is shown in a circle in the figure in an enlarged manner is an example of electron emitting element, shown is a surface conduction type emitting element which consists of a positive electrode 107, a negative electrode 108 and an electron emitting portion 109.

Further, a stripe like grid electrode GR is provided at some point between the base plate S and the faceplate FP. The grid electrodes GR are provided in N pieces perpendicular to the above described element array, each electrode being provided with an empty hole Gh for transmitting electron beam. The empty holes Gh may be provided in one-to-one correspondence to each electron emitting element as shown in the example of FIG. 13 or a large number of fine holes may be provided in a mesh-like manner. Each grid electrode is electrically connected to the outside of the vacuum vessel by means of terminals $G_1$–$G_n$.

In this panel, an XY matrix is formed by "1" electron emitting element columns and "N" grid electrode rows. By simultaneously applying modulation signal corresponding to a line of image to the grid electrode rows in synchronization with the sequential column-by-column drive (scanning) of the electron emitting columns, irradiation of each electron beam onto the fluorescent material is controlled to display an image line by line.

Figure 3:
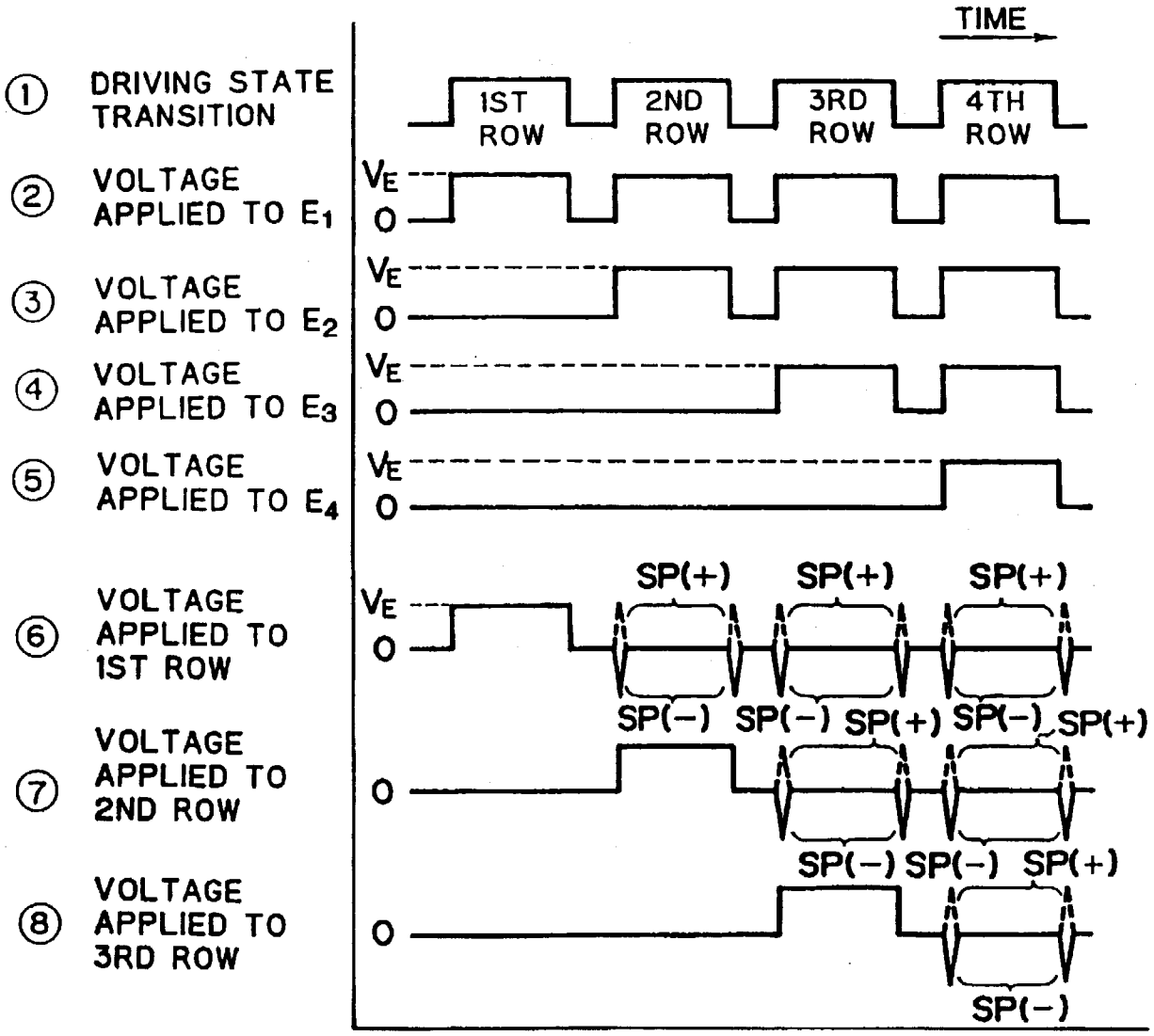
FIG. 3 PRIOR ART
FIG. 3 is a graph for explaining the spike-like reverse voltage SP(−) which has been problem in the conventional multi-electron beam source.

In an image display panel as shown in the figure, when the conventional driving method as described with reference to FIG. 2 and FIG. 3 is performed, deterioration in characteristic of the electron emitting elements has been substantial due to the spike-like applied voltage and luminance irregularity and flickering of image or defect in pixel have occurred after several hundreds to one thousand hours. In the case where the driving method according to the present invention as described was applied, its life was made at least ten times longer and it was thereby possible to improve practicality as a display device.

Further, in the conventional example, an instantaneous light emission of a pixel which should be in its non-emission state occurred in some cases due to the fact that unnecessary electron emission had occurred in an electron emitting element column which should not be being scanned, resulting in problems of crosstalk and/or reduction in contrast of the image.

In the case where the driving method of the present invention was used, however, it was possible to solve the problems as described because unnecessary electron emission could be prevented. It was thus possible to greatly improve the picture quality of the displayed image.

As has been described, according to the present invention, since it is possible to prevent application of spike-like steep voltage to the electron emitting elements at unnecessary timings, there are such advantages as that emission of electron at such unnecessary timings may be completely prevented and that the practical life of the electron emitting element is made at least ten times longer.

Further, in the case where a multi-electron beam source in which the present invention is applied is adapted to the electron beam source of a panel CRT, crosstalk in image and/or reduction in contrast, problems in the conventional example, may be solved. In addition to provision of high quality image, the life of the device may be made longer ten times or more, thereby greatly improving its practical value.

An example of fabrication process of the electron emitting elements (surface conduction type emitting element) used in the above embodiments will be described below.

[Fabrication Example of Electron Emitting Element]

Figure 14A:
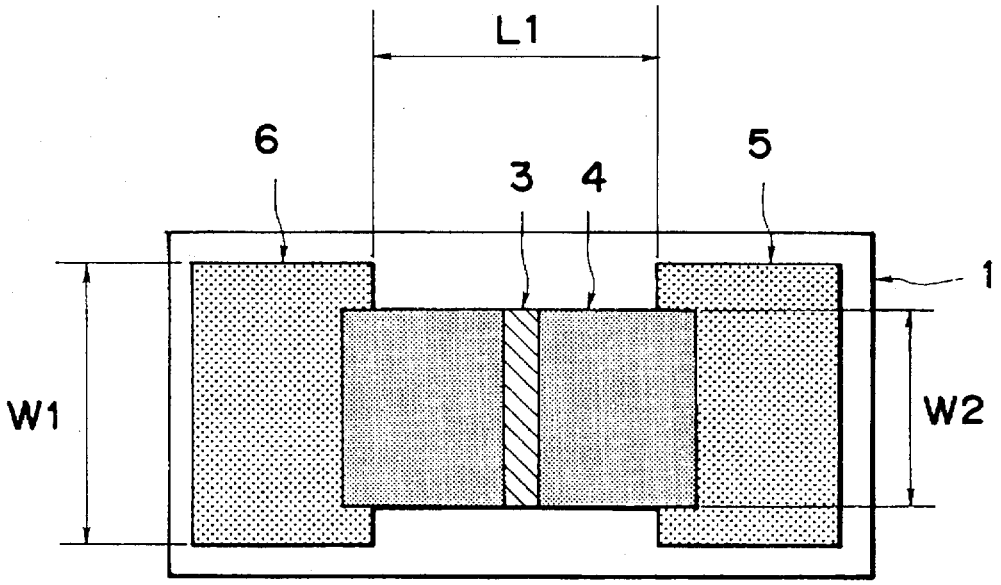
FIGS. 14A and 14B schematically show the construction of the surface conduction type emitting element used in the above embodiments.
Figure 14B:
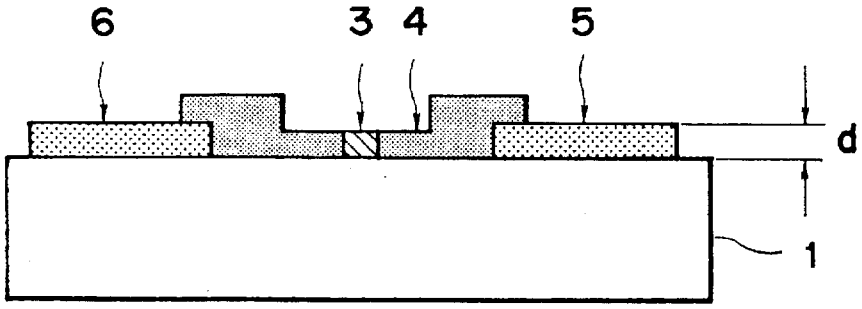

An electron emitting element of the type as shown in FIGS. 14A and 14B was fabricated as an electron emitting element of the present embodiment. FIG. 14A shows the top view of the element and FIG. 14B shows a section of the same. Numeral 1 in FIGS. 14A and 14B is a substrate of an insulating material; numerals 5 and 6 denote element electrodes for applying voltage to the element; numeral 4 denotes a film including an electron emitting portion; and numeral 3 denotes the electron emitting portion. It should be noted that, in the figure: L1 represents the element electrode spacing between the element electrode 5 and the element electrode 6; W1 represents the width of each element electrode; d represents the thickness of the element electrodes; and W2 represents the width of the elements.

Fabrication method of the electron emitting element of the present embodiment will be now described with reference to FIGS. 15A to 15C.

Figure 15A:
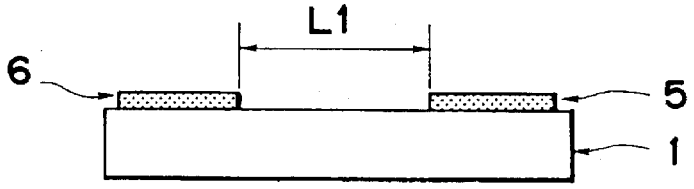
FIGS. 15A, 15B and 15C present a view explanatory of a fabricating method of the surface conduction type emitting element used in the above embodiments.

(1) After sufficiently washing a quartz substrate which was used as the insulating material substrate 1 using an organic solvent, the element electrodes 5, 6 made of Ni were formed on the surface of the substrate 1 FIG. 15A). At this time, the element electrode spacing L1 was 3 microns; the width W1 of the element electrodes was 500 microns; and the thickness d thereof was 1000 angstrom.

Figure 15B:
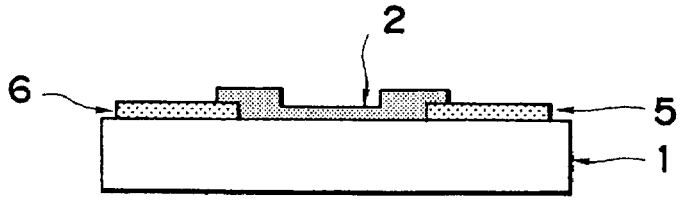

(2) After applying a solution containing organic palladium (product of Okuno Seiyaku, ccp-4230), heat treatment was performed for ten minutes at 300° C. to form a film of fine particles consisting of palladium oxide (PdO) particles (average particle size: 70 angstrom), which was used as the film 2 for forming electron emitting portion (FIG. 15B). Here, the electron emitting portion forming film 2 was made to have its width (width of the element) W of 300 microns and was positioned to substantially the center between the element electrodes 5 and 6. Further, the film thickness of the electron emitting portion forming film 2 was 100 angstrom and sheet resistance value thereof was $5\times10^4\Omega/\square$. It should be noted that what is referred here to as a fine particle film is the film constituted by an ensemble of a plurality of fine particles and refers not only to the state of the film where the fine particles are individually positioned in a dispersed manner in its fine structure but also to the state where the fine particles are adjacent to one another or overlapped each other (including the manner of islands). Their particle size refers to the diameter of each fine particle which may be identified to have the form of a particle in the above described states.

Figure 15C:
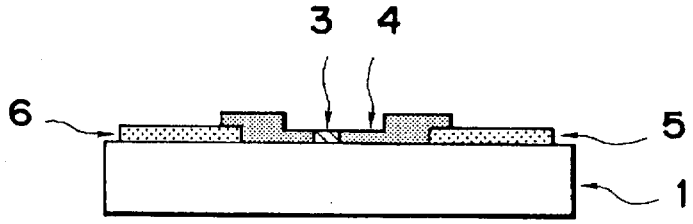

(3) Next, as shown in FIG. 15C, the electron emitting portion forming film 2 was subjected to an electrical conduction processing (forming) by applying a voltage between the element electrodes 5 and 6 to form the electron emitting portion 3. The voltage waveform of the forming is shown in FIG. 17.

Figure 17:
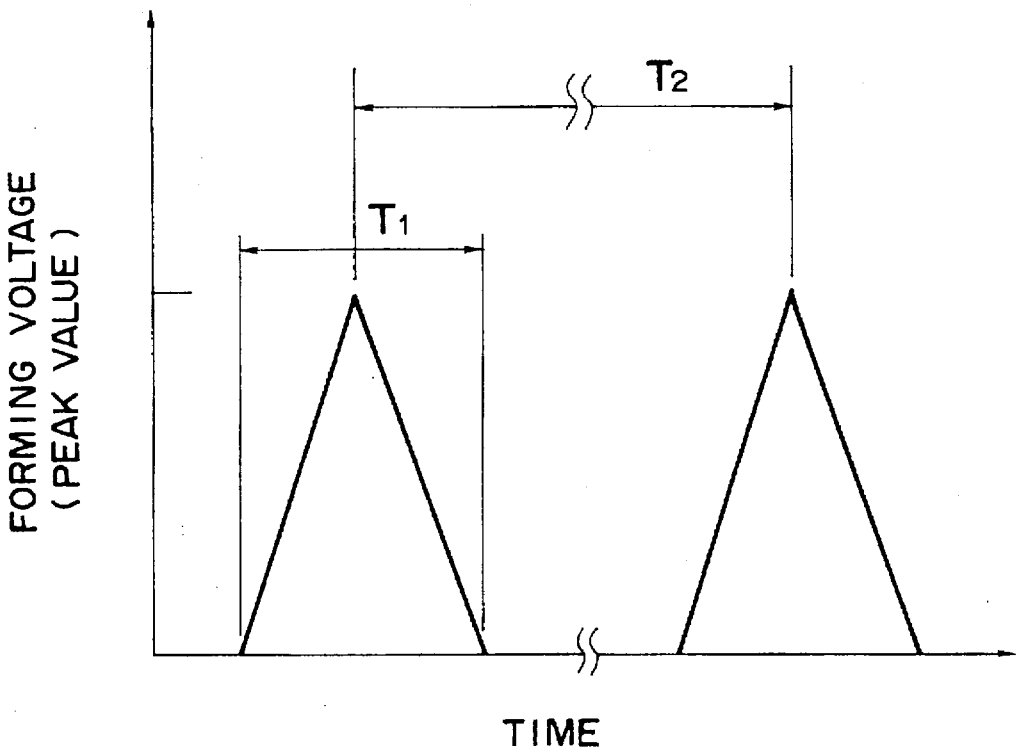
FIG. 17 shows voltage waveform in forming processing performed in the course of fabrication of the surface conduction type emitting element used in the above embodiments.

In FIG. 17, T1 and T2 represent pulse width and pulse spacing, respectively, of the voltage waveform. In the present embodiment, T1 was 1 millisecond while T2 was 10 milliseconds, and peak value (peak voltage at the time of forming) of the triangular wave was set to 5 V. The forming was performed for 60 seconds under the vacuum of $1\times10^{-6}$ torr. The electron emitting portion 3 formed in this manner was in the state where fine particles containing palladium elements as their main component were positioned in a dispersed manner. The average particle size of the fine particles was 30 angstrom.

Figure 16:
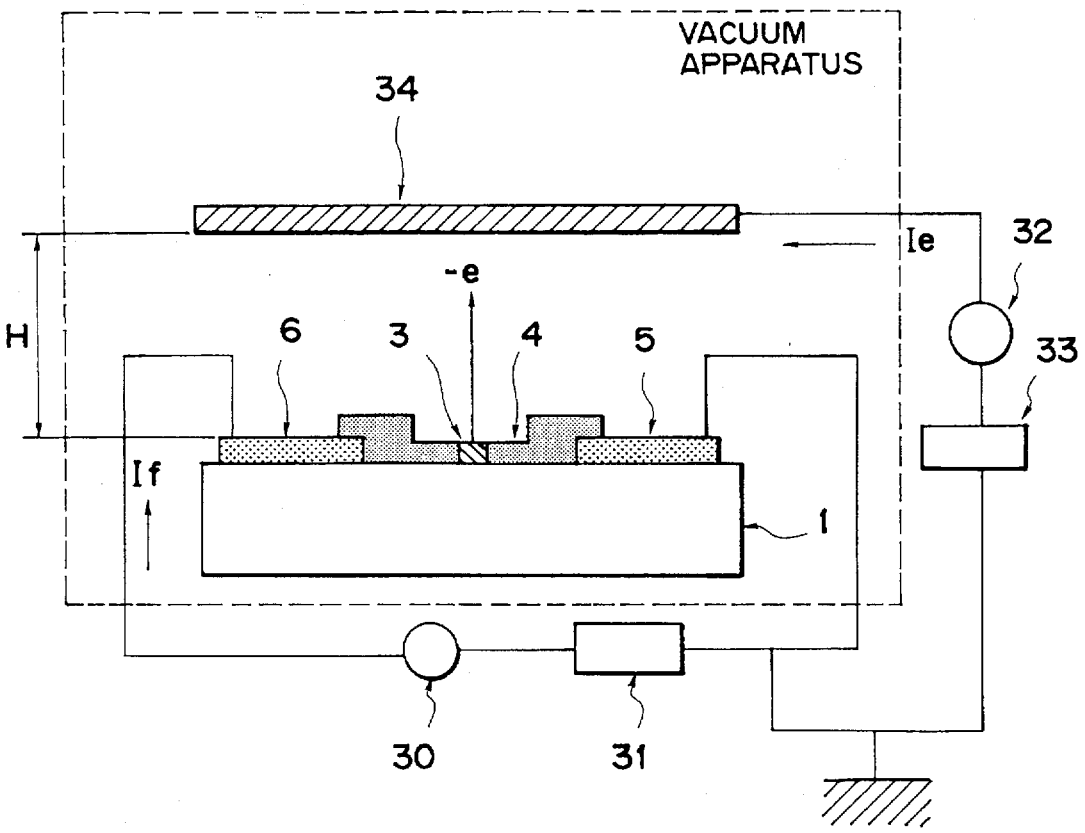
FIG. 16 schematically shows the construction of an evaluation device for performing measurement of the electron emitting characteristic of the surface conduction type emitting element used in the above embodiments.

Electron emission characteristic was measured of the element fabricated as described. FIG. 16 schematically shows the construction of the device for measurement and evaluation.

In FIG. 16, too, numeral 1 denotes the insulating material substrate, numerals 5 and 6 denote the element electrodes, numeral 4 denotes a film containing the electron emitting portion, and numeral 3 denotes the electron emitting portion. Numeral 31 denotes a power supply for applying voltage to the element; numeral 30 denotes an ampere meter for measuring the element current If; numeral 34 denotes an anode electrode for measuring emitting current Ie to be generated from the element; numeral 33 denotes a high voltage power source for applying voltage to the anode electrode 34; and numeral 32 denotes an ampere meter for measuring the emitting current. In measuring the above element current If and the emitting current Ie of the electron emitting element, the power supply 31 and the ampere meter 30 were connected to the element electrodes 5, 6 while positioned above the electron emitting element was the anode electrode 34 to which the power source 33 and the ampere meter 32 were connected. Further, the present electron emitting element and the anode electrode 34 are located within a vacuum apparatus, equipments necessary for a vacuum apparatus such as an evacuation pump and a vacuum gauge (not shown) being provided to the vacuum apparatus. Thus measurement and evaluation of the element may be performed under a desired vacuum. It should be noted that, in the present embodiment, the distance between the anode electrode and the electron emitting element was 4 mm, the electric potential of the anode electrode was 1 kV, and the degree of vacuum in the vacuum apparatus at the time of measuring the electron emitting characteristic was set to $1\times10^{-6}$ torr.

The system for measuring and evaluation as described was used to apply an element voltage between the electrodes 5 and 6 of the present electron emitting element so as to measure the element current If and the emitting current Ie flowing at that time. For the present element, at the element voltage of 14 V, the element current If was 2.2 mA and the emitting current Ie was 1.1 μA. The electron emission efficiency, n=Ie/If (%), thereof was 0.05%.

While in the above described embodiment forming was performed by applying triangular pulses between the electrodes of the element in forming the electron emitting portion, the waveform to be applied to between the electrodes of the element is not limited to the triangular wave. A desired waveform such as a rectangular wave may also be used. Peak value, pulse width and pulse spacing thereof, too, are not limited to the above described values. Desired values may be selected as far as the electron emitting portion may be formed in an excellent manner.

It should be noted that an electron emitting element used in the above described embodiment is characterized as the electron emitting element having an electron emitting portion in which fine particles are positioned in a dispersed manner between the electrodes on a substrate. In particular, it is desirable that the electron emitting element has the electrode spacing L1 of 0.2 μm–5 μm and the average particle size of the fine particles in the electron emitting portion 3 is set to within the range of 5 Å–1000 Å. Further, in addition to Pd, those which may be used as the above fine particles include: such metals as Nb, Mo, Rh, Hf, Ta, W, Re, Ir, Pt, Ti, Au, Ag, Cu, Cr, Al, Co, Ni, Fe, Pb, Cs, Ba; such boronic compounds as $LAB_6$, $CeB_6$, $HfB_4$, $GdB_4$; such carbides as TiC, ZrC, HfC, TaC, SiC, WC; such nitrides as TiN, ZrN, HfN; such metal oxides as PdO, $Ir_2O_3$, $SnO_2$, $Sb_2O_3$; such semiconductors as Si, Ge; and such as carbon, Ag, Mg.

Though in the above embodiments, the electron emitting part is illustrated as having surface conduction type electron emitting elements, the electron emitting element in the present invention should not be restricted to a surface conduction type but may be an MIM type element.

What is claimed is:

1. A multi-electron beam source comprising an electron emitting element part including:

a plurality of electron emitting elements provided two-dimensionally in a matrix like arrangement on a substrate;

opposing terminals of electron emitting elements arranged adjacently in the column direction thereof being electrically connected to each other;

terminals on the same side of all the electron emitting elements in the same row being electrically connected; and the plurality of electron emitting elements being arranged in "m" rows, "m" representing a number of two or more, and a driving circuit part for driving said electron emitting element part, wherein said multi-electron beam source has means for preventing a spike-like voltage from being applied to said electron emitting elements, and wherein said means for preventing a spike-like voltage comprises a rectifying element connected in parallel with the electron emitting elements of a row of electron emitting elements for removing a spike-like noise superposed onto the driving pulse generated by said driving circuit part and a resistor connected in series to the rectifying element.

2. An image display device comprising a multi-electron beam source comprising an electron emitting element part including:

a plurality of electron emitting elements provided two-dimensionally in a matrix like arrangement on a substrate;

opposing terminals of electron emitting elements arranged adjacently in the column direction thereof being electrically connected to each other;

terminals on the same side of all the electron emitting elements in the same row being electrically connected; and the plurality of electron emitting elements being arranged in "m" rows, "m" representing a number of two or more, and a driving circuit part for driving said electron emitting element part, wherein said multi-electron beam source has means for preventing a spike-like voltage from being applied to said electron emitting elements;

grid electrodes having a stripe shape in the column direction and arranged thereabove in the row direction of the two-dimensionally arranged electron emitting elements forming the multi-electron beam source; and a fluorescent material target for making an image visible by irradiation of electron beam provided further thereabove, wherein said means for preventing said spike-like voltage comprises a rectifying element connected in parallel to the electron emitting elements of a row of electron emitting elements for removing a spike noise superimposed onto the driving pulse generated by said driving circuit part and a resistor connected in series to the rectifying element.

3. A multi-electron beam source comprising:

an electron emitting element part including a plurality of electron emitting elements provided on a substrate, said electron emitting elements being arranged two-dimensionally in a matrix like arrangement into two or more rows;

a driving circuit part for generating a driving pulse to drive said electron emitting element part; and means for preventing a spike-like voltage from being applied to said electron emitting elements by removing a spike noise superposed onto the driving pulse, said means including a rectifying element connected in parallel to the electron emitting elements of a row and a resistor connected in series with the rectifying element.

4. An image display device comprising the multi-electron beam source of claim 3; grid electrodes having a stripe shape in the column direction and arranged thereabove in the row direction of the two-dimensionally arranged electron emitting elements forming the multi-electron beam source; and a fluorescent material target for making an image visible by irradiation of the electron beam provided further thereabove.

5. A multi-electron beam source according to claim 1, wherein said rectifying element is a Zener diode.

6. A multi-electron beam source according to claim 2, wherein said rectifying element is a Zener diode.

7. A multi-electron beam source according to claim 3, wherein said rectifying element is a Zener diode.

8. A multi-electron beam source according to claim 4, wherein said rectifying element is a Zener diode.

* * * * *

UNITED STATES PATENT AND TRADEMARK OFFICE

CERTIFICATE OF CORRECTION

PATENT NO. : 5,682,085

DATED : October 28, 1997

INVENTOR(S): HIDETOSHI SUZUKI ET AL.

It is certified that error appears in the above-identified patent and that said Letters Patent is hereby corrected as shown below:

ON THE TITLE PAGE AT [56], U.S. PATENT DOCUMENTS
"4,904,095 2/1990 Tsukamoto et al." should read
--4,904,895 2/1990 Tsukamoto et al.-- and
"Dark" should read --Park--.

COLUMN 1
Line 19, "(M.I. Elinson)" should be deleted;
Line 44, "filed" should read --field--.

COLUMN 4
Line 35, "embodiment 4." should read --Embodiment 4.--.

Signed and Sealed this

Nineteenth Day of May, 1998

Bruce Lehman

*Attest:*

BRUCE LEHMAN

*Attesting Officer*

*Commissioner of Patents and Trademarks*